US005529362A

United States Patent [19]

Gidos

[11] Patent Number: 5,529,362

[45] Date of Patent: Jun. 25, 1996

[54] REMOVABLE, REUSABLE HANDLE AND MAILING LABEL BASE

[76] Inventor: John P. Gidos, 9 Kinzua Rd., Ludlow, Pa. 16333

[21] Appl. No.: 318,183

[22] Filed: Oct. 5, 1994

[51] Int. Cl.[6] ..... A45F 5/10; B65D 63/18

[52] U.S. Cl. ..... 294/151; 294/154; 294/167

[58] Field of Search ..... 294/27.1, 137, 294/138, 141, 142, 146, 149–157, 165, 167, 168, 170; 16/110.5, 114 R; 150/107, 109, 110; 190/115–117; 220/758, 761, 768; 229/117.09, 117.19, 117.22, 117.23, 921

[56] References Cited

U.S. PATENT DOCUMENTS

| | | | |
|---|---|---|---|
| 473,531 | 4/1892 | Stone | 294/157 |
| 509,631 | 11/1893 | Tollner | 294/146 |
| 512,772 | 1/1894 | Ward | 294/154 X |
| 538,988 | 5/1895 | Ussher | 294/150 |
| 562,027 | 6/1896 | Phelan | 294/155 |
| 822,349 | 6/1906 | Connett | 294/154 |
| 1,137,548 | 4/1915 | Spurrier | 294/167 X |
| 1,160,878 | 11/1915 | Goldberg et al. | 294/165 X |
| 1,243,638 | 10/1917 | Spurrier | 294/154 |
| 1,559,286 | 10/1925 | Seaman et al. | 294/170 |
| 2,511,317 | 6/1950 | Arneson | 294/27.1 X |
| 3,031,359 | 4/1962 | Blank et al. | 294/27.1 X |
| 3,153,507 | 10/1964 | House | 294/27.1 X |
| 3,172,586 | 3/1965 | Lu | 294/155 |
| 4,828,310 | 5/1989 | Schmidt et al. | 294/150 X |
| 4,919,466 | 4/1990 | Consler et al. | 294/170 |
| 5,186,542 | 2/1993 | Seabold | 294/27.1 X |

FOREIGN PATENT DOCUMENTS

| | | | |
|---|---|---|---|
| 2050 | of 1911 | United Kingdom | 294/149 |

*Primary Examiner*—Johnny D. Cherry
*Attorney, Agent, or Firm*—Charles L. Lovercheck; Wayne L. Lovercheck

[57] ABSTRACT

A removable, reusable handle for packages, boxes and other lading is disclosed. The handle has a base with first holes that receive a flexible handle member. A support member on the base has a slot. The handle member is in the form of a loop which extends through the slot and may be folded into the slot. A lashing is received in second holes in the base for attaching the handle to lading. The support has a message receiving area adjacent the slot.

21 Claims, 2 Drawing Sheets

REMOVABLE, REUSABLE HANDLE AND MAILING LABEL BASE

BACKGROUND OF THE INVENTION

This invention relates to handles, and more particularly to a removable, reusable handle for use with various sizes and shapes of package parcels and other forms of lading.

Removable, reusable handles are in common usage. Handles protect hands from extreme temperature and provide the ability to pick up objects that otherwise would be difficult to grasp. As the object to be lifted becomes heavier, the importance of the handle increases.

A major problem with these types of handles is that some are constructed of wire, with a hook at each end to engage the string of the lashings. Others have other attaching means. Not only are such handles not suited for use with straps, they are hard on hands and not sturdy enough for heavy or repeated usage.

Accordingly, a need exists in the art for a package handle which allows for easy insertion into existing lashing, regardless of the shape of the lashing, and which will not slip out of the lashing when the object is lifted or while the object is being carried.

A further need exists for a package handle which can be used for either a flat strapping which is sturdy enough for use on many different packages or lashings and which is easily removable from a given package and which will not slip off a package while under load.

A further need exists for a package handle which can be used for a flat strapping which is easily moved from package to package, not easily released from a package while under heavy load, and comfortable to grip even when used with heavy loads.

Other objects, because of their physical size or because of their weight, are difficult to pick up and carry. Often several objects must be lashed together so that they can be carried as one bundle. Several traditional methods have been used for this purpose, beginning with twine wrappings and extending through exotic straps of many different materials. Handles have been fashioned to slip over twine to ease the burden of carrying heavy objects. These handles usually have circular eyes so that the twine lashing will pass through the eyes of the handle making a secure structure. Typically, these handles become a permanent part of the lashing.

Applicant is aware of the following U.S. Pat. Nos. 1,160,878 to Mendelson; 1,559,286 to Seaman; 2,511,317 to Arneson; 3,031,359 to Blank; 3,153,507 to House; 4,919,466 to Consler and 5,186,542 to Seabold.

SUMMARY OF THE INVENTION

To solve the aforementioned problems, Applicant has provided a removable, reusable handle which has a section disposed on either side of a grippable handle with flat sections arranged to slip onto a flat lashing.

Applicant has provided a removable, reusable handle and identification support. The device provides an innovative, integrated construction of a removable, reusable handle to carry large cumbersome parcels and packages. The support includes a support station for written information, bar codes and electronic support resources. The invention provides a simple and flexibly concealed, integrated variable structure.

The invention is generally made of a bottom unit, an upper unit, handle or strap concealed by a cover together with suitable lashings to accommodate a variety of parcels, packages or boxes. A strap-like member, in the form of a loop, passes through holes in the plate-like base. The strap is received in a recess in the support and a cover is hinged to the support. The support can be used to carry information like instructions and specifications. The support serves as more than one function. Not only is it designed to serve as a base for a handle but it is also a base for mailing labels or other pertinent data or matter. Also, the base and support are so constructed that they will avoid catching on modern conveyor devices.

It is an object of the present invention to provide a removable, reusable handle and mailing label support that is simple in construction, economical to manufacture and simple and efficient to use.

It is another object of the present invention to provide an improved removable, reusable handle and information support.

The above objects should be construed to be merely illustrative of some of the more pertinent features and applications of the invention. Many other beneficial results can be obtained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

With the above and other objects in view, the present invention consists of the combination and arrangement of parts hereinafter more fully described, illustrated in the accompanying drawings and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT

Figure 1:
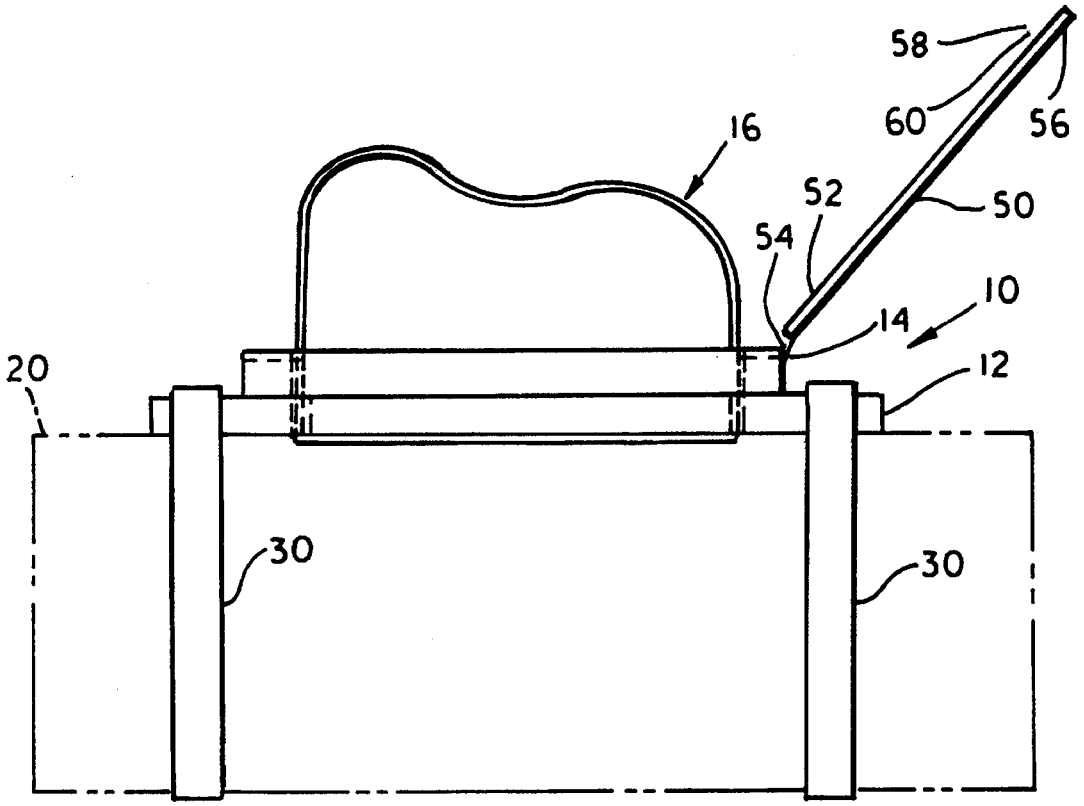
FIG. 1 is a side view of the removable, reusable handle and identification support in place on a package, according to the invention.
Figure 2:
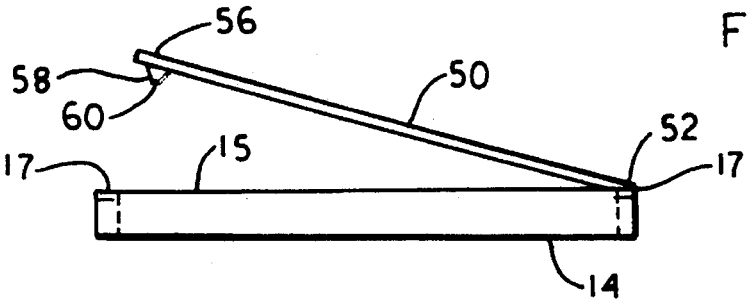
FIG. 2 is a side view of the support.
Figure 3:
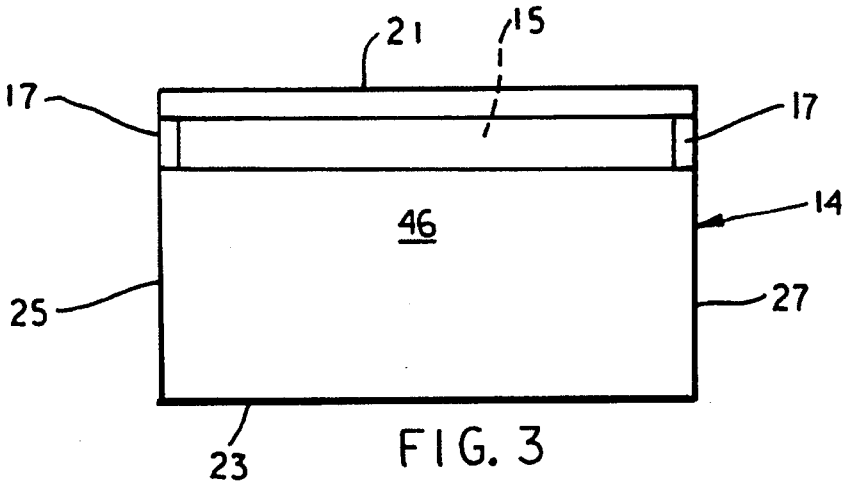
FIG. 3 is a top view of the support.
Figure 4:
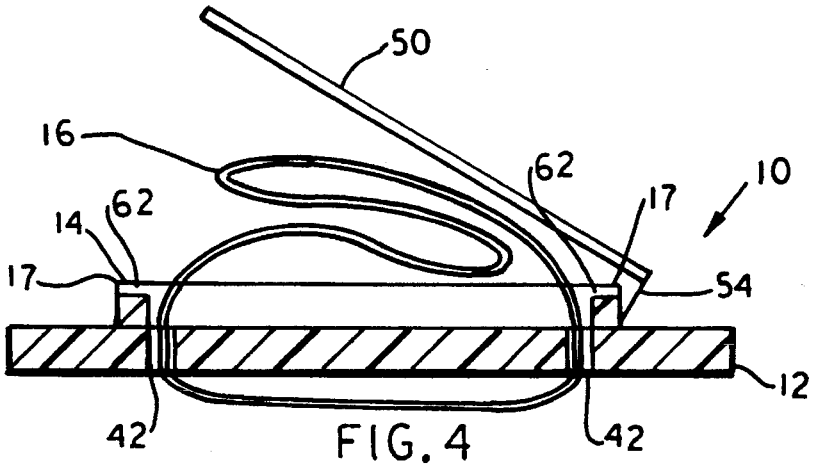
FIG. 4 is a cross sectional view of the removable reusable handle taken on line 4—4 of FIG. 6.
Figure 5:
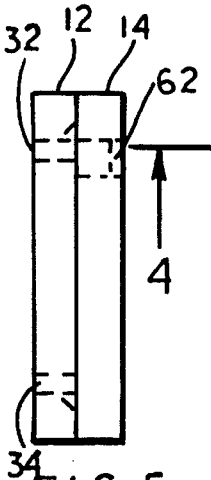
FIG. 5 is an end view of the support resting on the base.
Figure 6:
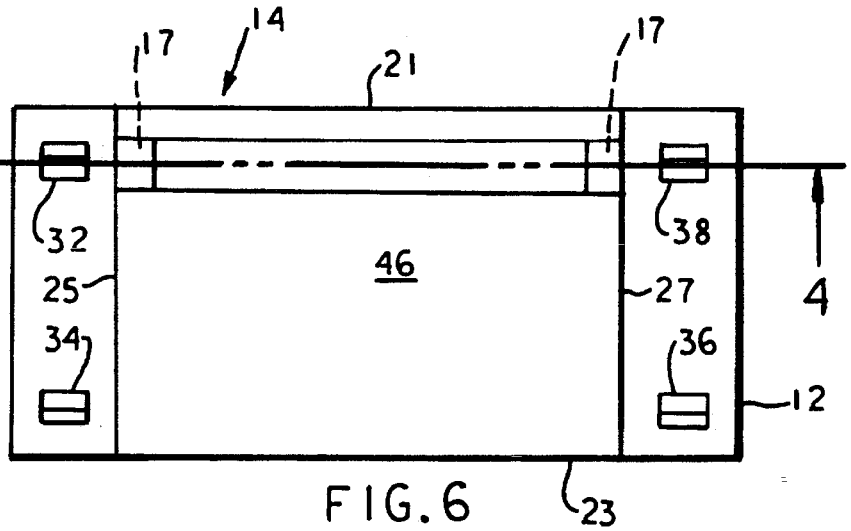
FIG. 6 is a top view of the support resting on the base.
Figure 7:
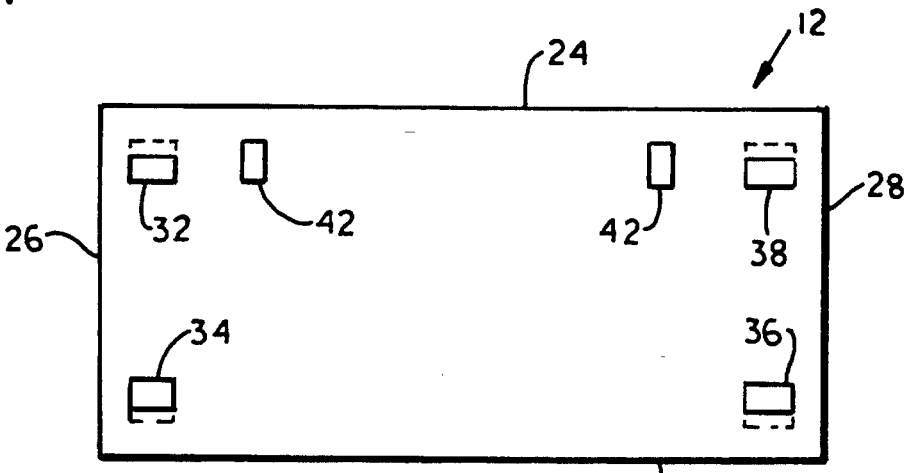
FIG. 7 is a top view of the base.

Now with more particular reference to the drawings, shown is carrier 10 made up of base 12, support 14 and removable, reusable handle 16, for carrying packages or parcels 20. Carrier 10 provides a flexible, concealed, simple, integrated, device that is of general utility in handling large packages or parcels 20. Base 12, support 14 and removable, reusable handle 16 are suitable for use with electronic support resources. Support 14 has area 46, ends 25,27 between slot 15 and side 23 of support 14 which may be used for carrying a message of written instructions, other written or graphic symbols, bar codes and the like. Support 14 is centered on base 12 and may also be used for carrying mailing and/or shipping labels as a mailing and/or shipping label station. Support 14 may be attached to base 12 by means of staples, cement or other well known attaching means. Support 14 can contain computer resource data. Support 14 may be attached to base 12 by pressure sensitive adhesive. Support 14 is removable and re-attachable to base 12 to allow substitute information to be applied to area 46. Support 14 has slot 15 adjacent side 21. Slot 15 is as wide as the width of handle 16 and handle receiving holes 42. Recesses 17, as deep as the thickness of handle 16, are formed in support 14 at each end of slot 15, forming ledges 62. Shoulders of recesses 17 are of a depth about equal to the thickness of cover 50 so that when cover 50 is closed, ends 52,56 rest on ledges 62 and the top surface of cover 50 will be flush with the top surface of support 14.

When support 14 is in place on base 12, slot 15 in support 14 is aligned with both handle receiving holes 42 so that the loop formed by the slack of handle 16 may be folded and stored in slot 15 above base 12, under cover 50. Handle 16 is concealed in slot 15, of support 14, when not in use. Handle 16 is made in the form of a continuous loop passing through handle receiving holes 42 in base 12 and can be stored in slot 15. The thickness of support 14 is great enough that slot 15 is of a depth at least as great as three times the thickness of handle 16 when folded back on itself and nested in slot 15.

Carrier 10 is non-intrusive, of slim design, well adapted to modern conveyor machines and simplifies the effort of handling large, cumbersome packages and parcels. Handle 16 is preferably made of a relatively thin, flat, narrow, flexible piece of strap material of polypropylene, or any other suitable material.

Base 12 and support 14 are shown as made of two separate parts, but could be made of a single piece of material, for example, of molded plastic. In the example shown, support 14 is made of a separate, flat, elongated, rectangular plate-like member. Lashing receiving slots 32,34,36,38 could be of any size or shape to accept any shape and size of lashing strap 30. Also, ends 26,28 of base 12 are suitable to receive lashings as adhesive tapes, reinforced adhesive tapes or other tapes to be used as lashings and being of sufficient strengths to attach base 12 to a package or parcel. Support 14 may be made of a rectangular plate-like member shorter than base 12 so that support 14 will not interfere with lashing receiving slots 32,34,36,38. Support 14 may be of a width equal to the width of base 12.

Cover 50 has end 52 hingedly connected to support 14 by hinge 54. End 56 has fastener 58 in the form of a detent. Handle 16 may be swung downward into slot 15 where it will be housed and concealed while in a shipping mode or position and is concealed and secured in position by lowering cover 50 into slot 15. Handle 16 will be secured in a closed position by fastener 58 or by other suitable locking mechanisms. Fastener 58 may have a detent 60 to snap under ledge 62 on support 14. When cover 50 is in a closed position, cover 50 is flush with the top surface of support 14 and the loop formed in handle 16 may be stored below cover 50 in slot 15.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. In combination a removable, reusable handle and a base;

parcel or packaging attaching means on said base for attaching said base to lading;

longitudinally spaced handle receiving holes extending through said base adjacent one side of said base;

said handle extending through said handle receiving holes;

a support member supported on said base;

a slot in said support member overlying said handle receiving holes for receiving said handle; and, said support member having a space thereon to receive a message.

2. The combination recited in claim 1 wherein said handle is in the form of a loop and adapted to be folded and stored in said slot;

a cover hinged to said support member and adapted to swing to a position over said slot to cover said handle; and, said cover being adapted to swing to a position away from said slot providing access to said handle.

3. The combination recited in claim 2 wherein said cover has a distal end; and, a detent on said distal end for holding said cover in a closed position.

4. The combination recited in claim 3 wherein said base is in the form of a flat plate-link member;

said attaching means having lashing receiving slots therein; and, said attaching means comprising a flexible strap received in said slots.

5. The combination recited in claim 2 wherein said handle is in the form of a relatively thin flexible strap.

6. The combination recited in claim 2 wherein a fastening member is disposed on said cover to hold said cover in a closed position.

7. The combination recited in claim 6 wherein said cover is a plate-like member adapted to be disposed in said slot when in a closed position overlying said handle.

8. The combination recited in claim 1 wherein said attaching means comprises relatively flat straps.

9. In combination, a removable, reusable handle and a base;

said base having a first side and a second side spaced from said first side with spaced elongated slots adjacent each end and generally parallel to said end for receiving lashings to attach said base between and generally aligned with two end slots to lading;

spaced handle receiving holes in said base adjacent said first side of said base and spaced a substantial distance from said second side of said base providing a clear space for a label; and, said handle being in the form of a loop received in said handle receiving holes.

10. The combination recited in claim 9 wherein a support is provided;

said support has a slot therein;

said support being adapted to rest on said base with said slot overlying said handle receiving holes and said handle extending through said slots to receive a hand of a person; and, message receiving means being disposed on said support.

11. The combination recited in claim 10 wherein said handle is a relatively thin, flat, flexible member in the form of a loop; and, said loop being adapted to be folded and nested in said slot.

12. The combination recited in claim 11 wherein a cover is provided and a hinge connects said cover to said support; and, said cover is adapted to swing into position over said slot to conceal said handle.

13. The combination recited in claim 12 wherein a cover is provided and said support has a flat top surface;

said cover having a flat top surface; and, said flat top surface of said cover being substantially co-planer with said top surface of said support when said cover is in a closed position.

14. The combination recited in claim 13 wherein a slot is provided in said support;

a recess is provided in said support at each end of said slot to receive said cover whereby ledges are provided at each end of said slot and said cover can rest on said ledges with said flat top surface of said cover disposed in a common plane with said flat top surface of said support.

15. The combination recited in claim 14 wherein said support has a substantial flat area adjacent said slot; and, said flat area comprising a message receiving means.

16. The combination recited in claim 15 wherein said base is made in a plate-like form.

17. The combination recited in claim 16 wherein said base has four corners and lashing receiving holes are disposed adjacent to each of said corners.

18. The combination recited in claim 17 wherein said support is a generally rectangular plate like member;

said support is of a width about equal to the width of said base and said support is shorter than said base; and, said support resting on a part of said base.

19. A removable, reusable handle for lading comprising a base and a support;

said base having lashing means thereon for attaching said base to said lading;

a handle on said base;

a slot in said support;

said slot in said support receives overlying said handle;

said handle extending through said slot and adapted to engage the hand of a person; and, said support having a large area adjacent said slot to support information.

20. The handle recited in claim 19 wherein said handle is a strap in the form of a loop; and, said handle being adapted to be folded and positioned into said slot.

21. The handle recited in claim 20 wherein a cover has a top surface adapted to be co-planar with said support when said handle is in a closed position.

* * * * *